United States Patent [19]

Forsell et al.

[11] Patent Number: 4,549,153

[45] Date of Patent: Oct. 22, 1985

[54] RESIDENTIAL CIRCUIT BREAKER WITH SLOT MOTOR

[75] Inventors: Kenneth A. Forsell, Port Washington; Peter J. Theisen, West Bend, both of Wis.

[73] Assignee: Eaton Corporation, Cleveland, Ohio

[21] Appl. No.: 528,949

[22] Filed: Sep. 2, 1983

[51] Int. Cl.[4] ..... H01H 77/10

[52] U.S. Cl. ..... 335/16; 335/195; 335/201

[58] Field of Search ..... 335/16, 23, 35, 195, 335/201; 200/147 R, 198 C, 153 G

[56] References Cited

U.S. PATENT DOCUMENTS

| | | | |
|---|---|---|---|
| 2,618,716 | 11/1952 | Boller et al. | 335/6 |
| 3,081,386 | 3/1963 | Koenig et al. | 335/9 |
| 3,185,059 | 6/1974 | Spoelman | 335/16 |
| 3,488,610 | 1/1970 | Powell | 335/23 |
| 4,056,798 | 11/1977 | Malick | 335/16 |
| 4,077,025 | 2/1978 | Slade et al. | 335/16 |
| 4,266,210 | 5/1981 | Mrenna et al. | 335/201 |

FOREIGN PATENT DOCUMENTS

| | | |
|---|---|---|
| 2039881 | 1/1971 | France . |
| 49-44446 | 12/1974 | Japan . |

*Primary Examiner*—John C. Martin
*Assistant Examiner*—George Andrews
*Attorney, Agent, or Firm*—Andrus, Sceales, Starke & Sawall

[57] ABSTRACT

A residential or commercial circuit breaker of the narrow width type, typically having a width of ¾ inch or 1 inch, is provided with a magnetically permeable slot motor 102 mounted within the case 2 and around both current carrying conductors 8 and 12 for concentrating magnetic repulsive force and boosting the contact separating force.

4 Claims, 10 Drawing Figures

Fig. 4
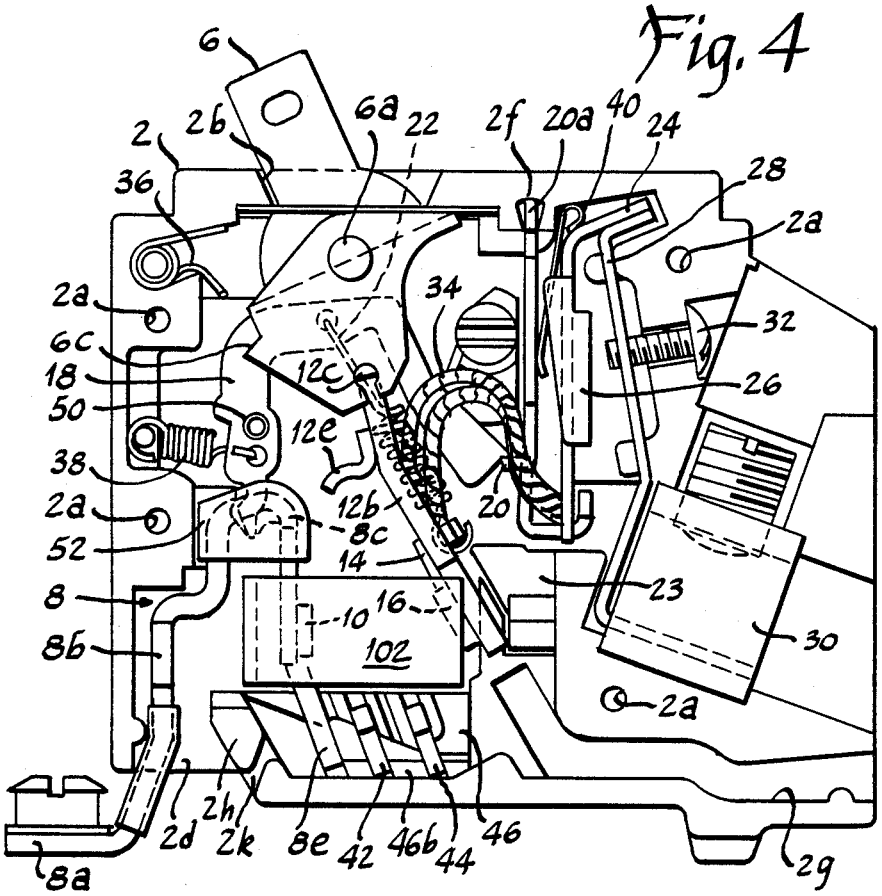
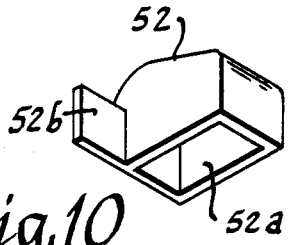
Fig. 10
Fig. 5
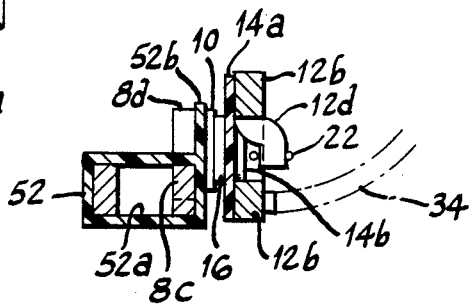

RESIDENTIAL CIRCUIT BREAKER WITH SLOT MOTOR

BACKGROUND AND SUMMARY

The invention relates to residential branch circuit breakers, which are the molded case, narrow width type, usually one inch or three quarters inch, such as shown in U.S. Pat. No. 3,081,386. These breakers are normally utilized in residential and commercial applications up to 240 volts.

Circuit breakers, and the panelboards or load centers to which they are mounted, are designed to be compact and physically compatible with existing apparatus. However, electrical utilities are providing increased available current in new installations. As a result, the short circuit interruption capacity requirement of narrow width circuit breakers has increased from 10,000 amps to 22,000 amps for new breaker designs, while existing apparatus designs place sever limitations on changes in physical arrangement and size.

In contrast, industrial breaker designs do not have such size constraints, and their much higher circuit interruption capacity involves different design criteria.

The present invention provides a residential breaker incorporating a magnetically permeable slot motor mounted within the narrow width case and around both current carrying conductors. Current flows through the conductors in reverse parallel opposite directions to develop magnetic repulsive force which is concentrated by the slot motor and urges separation of contacts. The slot motor is a U-shaped member receiving both conductors therein from one side. Increased short circuit interruption capacity is provided without resorting to wide case design or otherwise resorting to industrial breaker type design.

BRIEF DESCRIPTION OF THE DRAWINGS

FIG. 4 is a view similar to FIGS. 2 and 3 but showing the mechanism in an open position under short circuit conditions.

FIG. 5 is a sectional view taken along line 4—4 of FIG. 2.

FIG. 10 is an isometric view of an insulating cap used on the stationary contact assembly.

DETAILED DESCRIPTION

Figure 1:
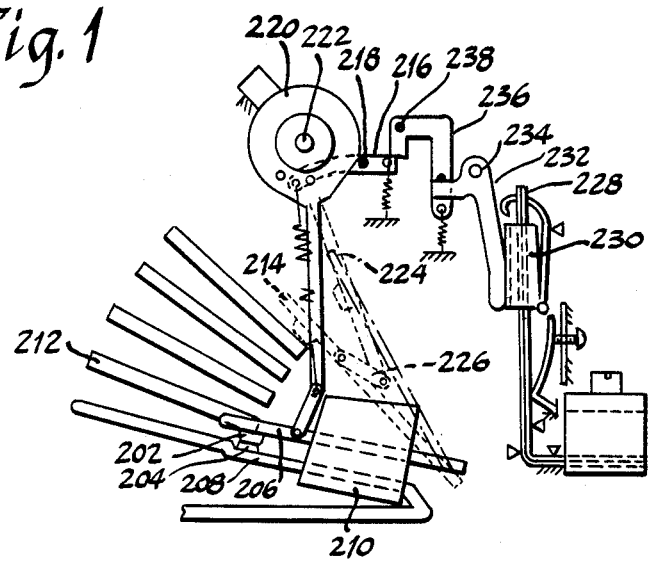
FIG. 1 is a schematic illustration of the invention, including a magnetically permeable slot motor in a narrow type breaker mechanism.

FIG. 1 schematically shows a residential or commercial circuit breaker having a pair of separable contacts 202 and 204 mounted on respective current carrying conductors 206 and 208. A magnetically permeable slot motor 210 is mounted around both conductors. Conductors 206 and 208 extend parallel to each other in slot motor 210. Current flow through the conductors in reverse parallel opposite directions to develop magnetic repulsive force concentrated by the slot motor and urging separation of contacts 202 and 204.

In preferred form, slot motor 210 has a U-shaped configuration. The slot motor receives both conductors therein from one side, such as the right open side. In the embodiment in FIG. 1, the conductors extend through the slot motor and emerge through the left open side, with contacts 202 and 204 leftward of the slot motor. Stationary conductor 208 is adjacent the bottom bight of the U. Movable conductor 206 moves upwardly between and parallel to the legs of the U, and through the open top of the U. Arc runners 212 dissipate the arc between the contacts as they separate.

Magnetic repulsive force developed between the movable and stationary conductors 206 and 208 as a result of current flow is concentrated by slot motor 210 and acts to boost the contact opening force. This repulsion force continues to accelerate the movable conductor 206 to position 214. Release of latch lever 216 about pivot 218 and clockwise rotation of handle 220 about pivot 222 allow the movable contact arm conductor 214 to rotate to the full opened position 224.

The contacts may be operated between their open and closed positions by operating handle 220 through pivot arm linkages 226. Thermal overload bimetal 228 and/or magnetic armature 230 trip latch 232 about pivot 234 in response to an overload condition. This releases intermediate lever 236 to pivot about point 238 to thus release latch lever 216 and enable opening of the contacts, boosted by the additional applied magnetic separating force.

FIGS. 2 through 10 show a particular implementation of the invention in a narrow width, three quarter inch, residential or commercial circuit breaker similar to that in copending U.S. application Ser. No. 376,801, filed May 10, 1982. The two most common widths for such circuit breakers are one inch and three quarter inch, which is the outside width dimension of the molded case.

Figure 2:
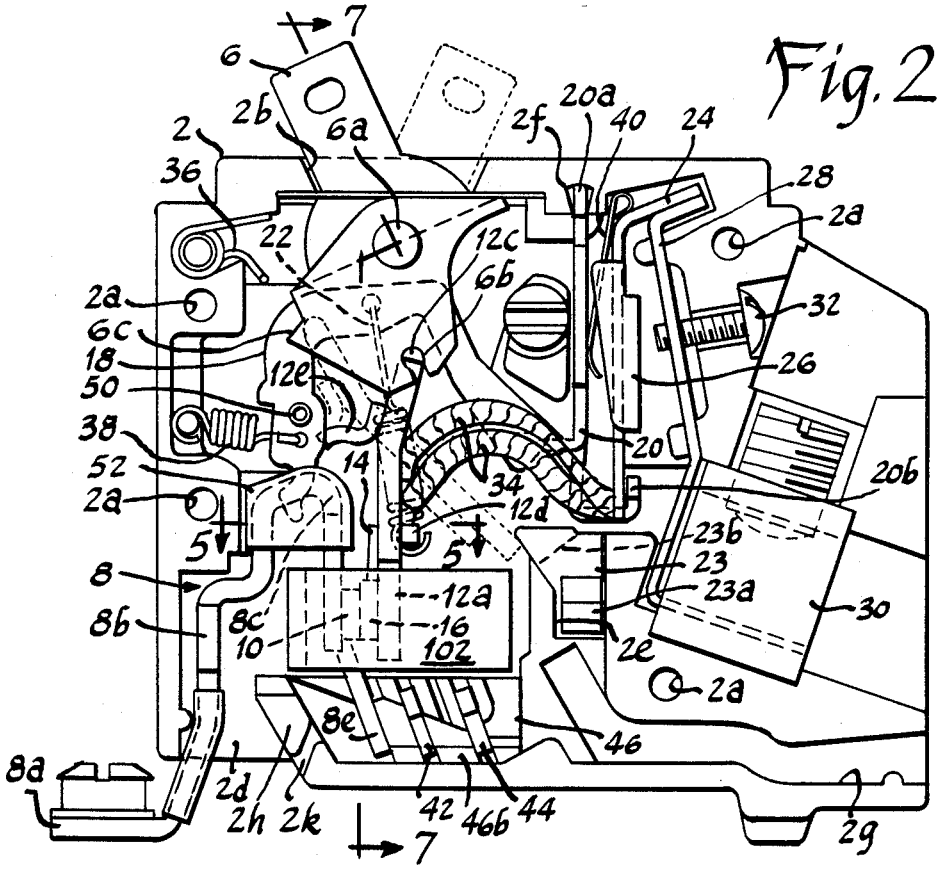
FIG. 2 is a side elevation view of a particular implementation of the invention in a three-quarter inch residential circuit breaker.
Figure 6:
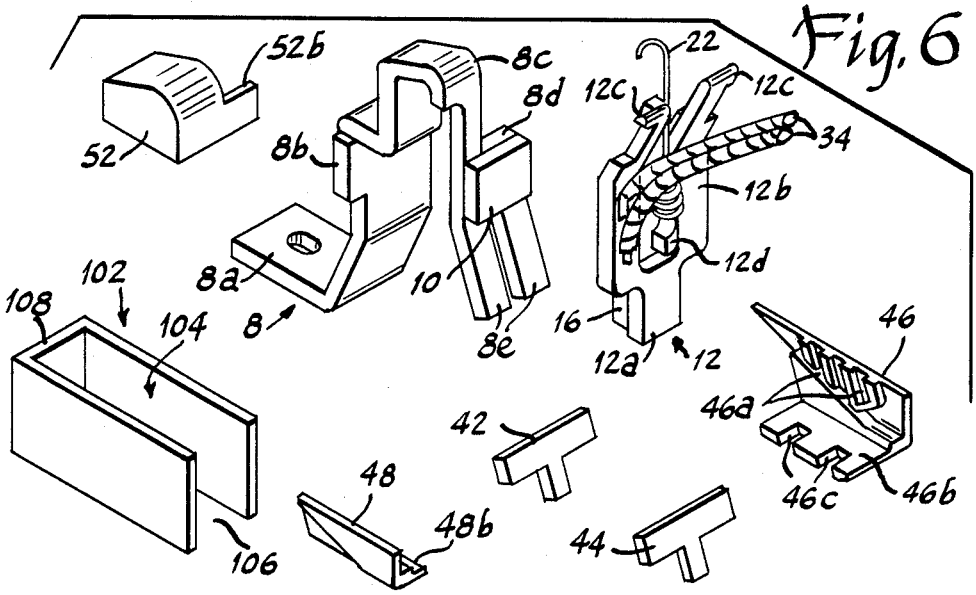
FIG. 6 is an exploded isometric view of the slot motor, and contact and arc extinguishing structures of FIGS. 2–4.
Figure 7:
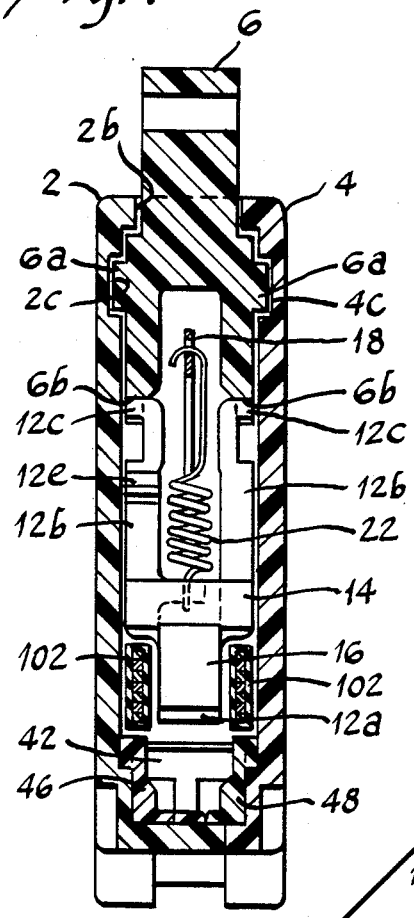
FIG. 7 is a transverse sectional view taken along line 7—7 of FIG. 2.
Figure 9:
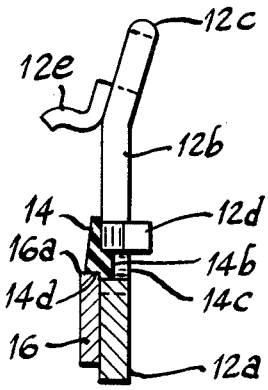
FIG. 9 is a longitudinal sectional view of the assembled movable contact assembly of FIG. 8.

Referring to FIGS. 2, 6, and 7, there is shown a residential or commercial circuit breaker having a case 2 of width less than or equal to about one inch, and having a pair of separable contacts 10 and 16 mounted on respective current carrying conductors 8 and 12. A magnetically permeable slot motor 102 is mounted within the case and around both conductors. Conductors 8 and 12 extend parallel to each other in slot motor 102. Current flows through the conductors in reverse parallel opposite directions to develop magnetic repulsive force concentrated by the slot motor and urging separation of contacts 10 and 16. In preferred form, slot motor 102, FIG. 6, has a U-shaped configuration and is covered or coated with dielectric material. The slot motor receives both conductors 8 and 12 therein from one side, such as top open side 104. One of the conductors, such as 12, is movable rightwardly toward the open end 106 of the U away from the bight 108 of the U.

Referring to FIGS. 2 and 7 of the drawings, there is shown a circuit breaker having a molded insulated housing 2 which has a shallow cavity formed therein to receive the operating mechanism of the circuit breaker. A molded cover 4 is secured over the open side of the housing 2 by a plurality of rivets (not shown) which are received in openings 2*a* of housing 2 and corresponding openings in the cover 4. The forward or upper wall of housing 2 has an opening 2*b* which cooperates with a similar opening in the cover for receiving an operating handle 6 of the breaker. Operating handle 6 has a pair of trunions 6*a* which are received in cylindrical recesses 2*c* and 4*c* in the housing and cover, respectively, to journal the handle 6 for pivotal movement.

A combination stationary contact and line-side terminal member 8 is mounted in the lower left-hand portion of the circuit breaker as viewed in FIG. 2, the terminal portion 8*a* projecting outwardly of the housing 2 through an opening 2*d* therein. The combined contact-/terminal member 8 is mounted in the housing 2 and cover 4 by a pair of laterally projecting tabs 8*b* (only one of which is visible in FIGS. 2 and 6) which are formed on the terminal portion and received in complementally formed recesses in the housing 2 and cover 4. The stationary contact portion of member 8 comprises an inverted U-shaped conductor portion 8*c* which has a reduced cross section with respect to the prevalent width of member 8 and is offset to one side of the member 8. The inverted U-shaped conductor portion 8*c* joins with a contact mounting pad 8*d*. A stationary contact 10 is secured to the mounting pad 8*d* by any suitable means such as spot welding, brazing, or the like. Projecting downwardly from the contact mounting pad 8*d* is a bifurcated arc runner 8*e* which is angled forwardly in the direction of the side at which the contact 10 is secured to the member 8 to facilitate arc motion off the contact 10 as will be described hereinafter.

Figure 8:
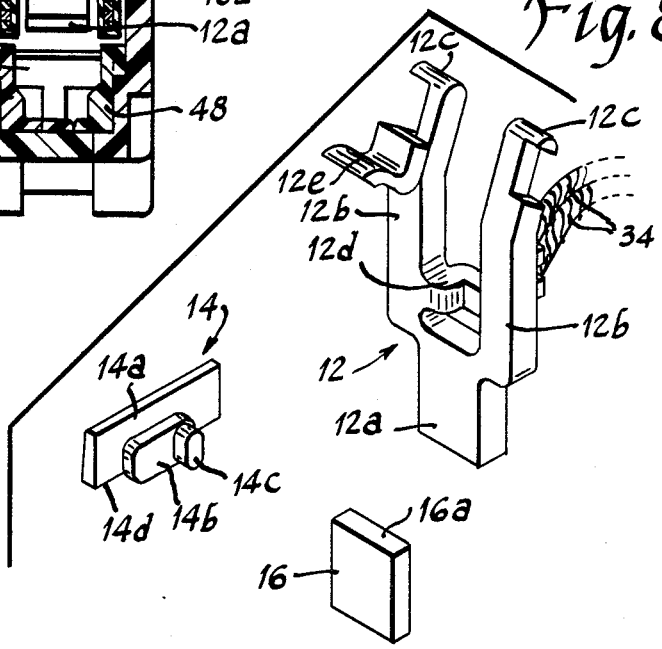
FIG. 8 is an exploded isometric view of elements comprising the movable contact assembly.

As best shown in FIGS. 6 and 8, a movable contact assembly comprises a flat Y-shaped movable contact arm 12 which has a stem portion 12*a* and a pair of upstanding legs 12*b*. The upper portions of legs 12*b* are formed over obliquely out of the plane of contact arm 12 and are provided at the ends with half-round, outwardly projecting ears 12*c* which are cooperatively received within keyhole slots 6*b* formed in depending flanges of the operating handle 6 to pivotally attach movable contact arm 12 to the operating handle 6. A hook 12*d* extends laterally from the housing-side leg 12*b* in the space between the two legs and is offset to the rear, or toward the side of the contact arm 12 opposite the member 8. As may be best seen in FIGS. 8 and 9, an insulator 14 and a contact element 16 are assembled to the movable contact arm 12. Insulator 14 comprises a rectangular cross arm 14*a* which has a rectangular boss 14*b* extending from a back side thereof which in turn has an oblong boss 14*c* extending therefrom to the same side. The rectangular boss 14*b* is made to fit snugly within the opening defined by the upper portion of stem 12*a*, the inner sides of legs 12*b* and the underside of hook 12*d* in the base of the Y-shaped contact arm 12 to prevent movement of the insulator in the plane of the front surface of contact arm 12. The boss 14*c* inderlies the portion of hook 12*d* which is offset to the rear of the contact arm 12 to further position the insulator 14 on the arm. Insulator 14 is placed to contact arm 12 such that the cross arm 14*a* lies flat against the flat surfaces of legs 12*b* with the rectangular boss 14*b* received in the aforementioned opening. With reference to FIG. 8, insulator 14 is assembled to contact arm 12 by rotating it ninety degrees counterclockwise in a horizontal plane and inserting the boss 14*b* into the aforedefined opening. As is more apparent in the longitudinal sectional view of movable contact arm 12 shown in FIG. 9, the rectangular boss 14*b* is offset to extend slightly below the bottom edge 14*d* of the cross arm 14*a* to present a forwardly facing surface in the same plane as the back of cross arm 14*a*. Contact element 16 is then secured to the stem portion 12*a* of movable contact arm 12 such that its upper edge 16*a* abuts the lower edge 14*d* of cross arm 14*a* and the upper corner of contact element 16 overlies the forward facing depending portion of rectangular boss 14*b* to trap insulator 14 in place on contact arm 12. Contact element 16 may be secured to arm 12 by any suitable means such as by spot welding, brazing or the like. A portion of stem 12*a* extends below the contact 16 and serves to draw the arc created upon contact separation away from the lower corner of the contact element 16 and direct it to the lower corner of the stem 12*a* of movable contact arm 12 instead. This reduces the erosion of the silver contact resulting from the arcing that occurs at contact separation.

A releasable latch lever 18 is pivotally supported at its left-hand end within a suitable formation in the housing 2. Latch lever 18 is essentially an inverted U-shaped member, the right-hand of which cooperates which a latch member 20 to restrain the latch lever 18 in the position shown in FIGS. 2 and 4. The bight portion of latch lever 18 is disposed between the depending side flanges of operating handle 6 and is provided with a hole which receives one end of a helical tension spring 22. The opposite end of spring 22 is connected to hook 12*d* of the movable contact arm 12 to provide an over center drive for arm 12 in a manner that is well known. Hook 12*d* is offset to the rear side of contact arm 12 and is covered by cross arm 14*a* of insulator 14 to provide protection for the lower loop of spring 22 against the arc which occurs at contact separation. Manual movement of operating handle 6 to the position shown in dotted lines in FIG. 2, carries the upper ends 12*c* of the movable contact arm 12 across the operating center line of spring 22 whereby the movable contact arm is driven to the dotted line position shown in FIG. 2 against a stop 23 located in the housing 2. Return movement of the operating handle 6 to the position shown in solid lines in FIG. 2 will carry the upper ends 12*c* of movable contact arm 12 back over center of the line of action of spring 22 to cause the movable contact 16 to close upon the stationary contact 10.

Stop 23 is preferably a separate member which is entrapped within the housing 2 and cover 4. At one end the stop 23 is received within a three-sided recess 2*e* in base 2. At the other end stop 23 is provided with a two step rectangular boss 23*a* which is received in a complementally formed recess in cover 4. A slot 23*b* is formed in stop 23 to provide clearance for the lower end of latch lever 18 when the latter is released. The stop 23 is made from a thermosetting plastic material instead of being formed as an integral part of the housing 2, which is made of a glass filled polyester compound, because the thermosetting plastic material has better impact absorbing and wear resistant properties than does the glass filled polyester material.

The latch 20 is a part of a thermal and magnetic overcurrent trip mechanism which further comprises a bimetal member 24 around which is secured a U-shaped pole piece 26. Latch member 20 is pivotally mounted at its upper end by outwardly projecting ears 20*a* which are respectively received within an opening 2*f* in the housing 2 and a similar opening in cover 4 to serve as an armature cooperable with the pole piece 26. The lower end of the latch member 20 is offset horizontally to the left in the drawings to present a latching surface for the cradle member 18 as best seen in FIG. 4. Latch member 20 also comprises a depending hook portion 20*b* which extends around the opposite side of the lower end of bimetal member 24 to be engaged thereby. Bimetal member 24 is mounted within the housing by attachment at its upper end to a conductor 28 which in turn connects to a load-side pressure connector 30. A calibrating screw 32 projects through a slot in the housing 2 and threadably engages an opening in conductor 28 to adjustably position the bimetal 24 and the pole piece 26 within the housing. Bimetal member 24 also has the ends of a pair of braided flexible conductors 34 attached to the left-hand face of its lower end such as by welding or brazing, the opposite ends of conductors 34 being connected to the cover-side leg 12*b* of movable contact arm 12 as viewed in FIG. 2.

Figure 3:
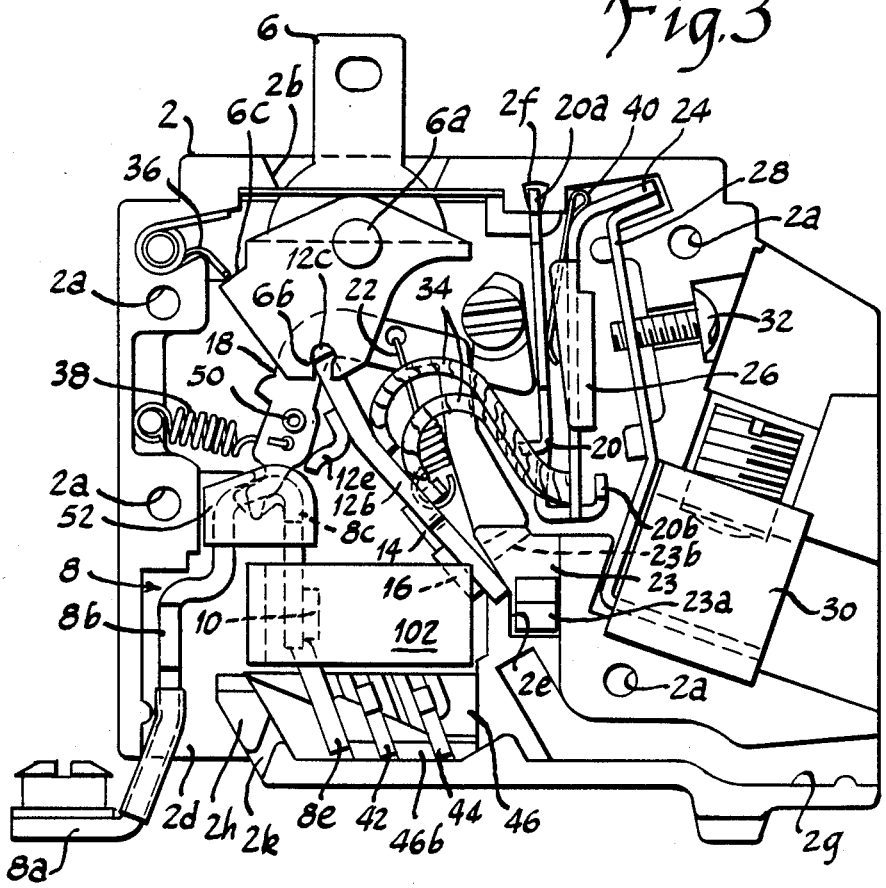
FIG. 3 is a view similar to FIG. 2 but showing the mechanism in a tripped position.

As so far described, a circuit can be seen to exist through the breaker when the mechanism is in the "on" position shown in FIG. 2 from the line side terminal 8*a* through the combination terminal and stationary contact member 8, stationary contact element 10, movable contact element 16, the cover-side leg 12*b* of movable contact 12, flexible conductors 34, bimetal 24, conductor 28 and load-side connector 30. In the event that excessive current flows through this circuit, the bimetal element 24 will become heated by the excessive current and will warp toward the right in FIG. 2 to cause its lower end to engage hook portion 24*b* and pull the latch member 20 to the right, thereby disengaging the latch portion from the latch lever 18 and releasing the latch lever to pivot clockwise about its left-hand end under the influence of spring 22. This movement of latch lever 18 carries the upper end of spring 22 over center of the upper ends 12*c* of movable contact arm 12. Once over center, the spring 22 urges the lower end of movable contact arm 12 counterclockwise, or to the right as viewed in FIG. 2, to separate contacts 10 and 16 and abut against stop 23. Spring 22 also drives the upper ends 12*c* of the movable contact arm 12 to the left as viewed in FIG. 2, thereby pivoting handle 6 clockwise until a projection 6*c* thereon engages with the end of a cushion spring 36 held in the upper lefthand corner of the housing 2. The handle then occupies a vertical "tripped" position as shown in FIG. 3 to provide indication that the breaker has tripped.

The breaker mechanism may also be tripped magnetically upon the occurence of a larger overload current. Magnetic tripping occurs when a relatively large surge of current flows through the bimetal 24 setting up a magnetic field within the pole piece 26 to attract armature 20 to pole piece 26 and thereby moving the latch portion to the right in the same manner as had been previously described in connection with the warping of bimetal 24. Upon removal of the excess current, the breaker may be reset merely by moving the handle 6 back to the "off" position whereby the upper end of movable contact arm 12 is pivoted across the upper end of over center spring 22, thereby further shortening the operating length of spring 22 and reducing its force. A resetting tension spring 38 is connected between a cylindrical boss on the housing 2 and the left-hand, pivoted leg of latch lever 18 to exert a counterclockwise bias on the latch lever 18. As the force on spring 22 is reduced, the force exerted by spring 38 overcomes the clockwise component exerted by spring 22 to move the latch lever in the counterclockwise direction and cause the right-hand end of latch lever 18 to reengage with the latching surface of latch 20. A leaf spring 40 is retained within the housing between bimetal member 24 and latch 20 to bias latch 20 to the left whereby it will reset with the latch lever 18 as the right-hand end of the latch lever is moved into latching position.

It has been a common expedient in breaker designs to include an interaction feature between the releasable latch lever and the movable contact arm such that when the breaker trips and the latch lever is released, the latch lever movement provides some impetus to movement of the movable contact arm. This is accomplished by means of a kicker which may be a portion of the latch lever or a projection attached to the latch lever which engages the movable contact arm. A kicker is provided in the breaker by means of a roll spring pin 50 which is mounted within a hole in the left-hand leg of latch lever 18 to project transversely on opposite sides of the lever. Movable contact arm 12 has a tab 12*e* secured to the housing-side leg 12*b* thereof to project toward the roll pin 50. Tab 12*e* is provided only on one leg of movable contact arm 12 to minimize additional mass of the movable contact and to provide a weld-breaking shear torque on the contacts by causing a twisting moment when pin 50 engages the tab 12*e* as the latch lever is released by latch 20. The keyhole slots 6*b* provide a looseness in the fit of the upper ends 12*c* of the contact arm within the handle and thereby a small, but important, amount of twisting or shear torque can be applied to assist in separating the contacts should they be welded.

Referring again to FIGS. 2 and 6, the circuit breaker includes an arc extinguishing structure which includes a pair of arc plates 42 and 44 and a pair of retainers 46 and 48 for positioning the arc plates within the housing. Retainers 46 and 48 are molded of glass filled polyester material having a high concentration of tri-hydrated alumina which emits a cooling gas and water when exposed to an electrical arc. Retainer 46 can be seen in FIG. 6 to have a pair of angularly oriented pockets 46*a* formed on the interior of a side-wall portion for receiving a leg of the respective arc plates 42,44. Retainer 46 also has a lateral projecting base 46*b* which has openings 46*c* for receiving the stem of the respective arc plates 42,44. Although not specifically shown in FIG. 6, retainer 48 also has angularly oriented pockets similar to pockets 46*a* for receiving the opposite legs of respective arc plates 42,44. A laterally extending base 48*a* cooperates with base 46*b* to close off the openings 46*c* trap the stems of arc plates 42, 44 in the openings 46*c* when the arc extinguishing structure is assembled within the circuit breaker. The left-hand edge of retainer 48 is formed complementally to the profile of the right-hand end of terminal/contact member 8, specifically, the pad 8*d* and arc runner 8*e*, and terminates immediately to the right of member 8. Although not specifically shown, the cavity of housing 2 and the interior of cover 4 are suitable configured to position the retainers 46 and 48 in place within the circuit breaker housing. For reasons to be explained more fully hereinafter, it can be seen that the arc plates 42, 44 are disposed substantially parallel to the bifurcated arc runner 8*e* of the terminal/stationary contact member 8 and that the spacing between arc runner 8*e* and arc plate 42 and between arc plates 42 and 44 is substantially equal.

The arc extinguishing structure also comprises a pair of openings in housing 2. The first opening is a passageway 2*g* which extends from the right-hand arc plate 44 to the right-hand end of the housing 2. The second opening is opening 2*d* previously described as an opening through which the terminal 8*a* projected. An upwardly projecting barrier 2*h* extends from the bottom of the circuit breaker housing 2 upwardly into the opening 2*d*, this barrier having a narrow slot 2*k* formed therein. Barrier 2*h* is recessed below the plane of mating surfaces of housing 2 and cover 4 so as not to close off the opening 2*d*, but merely to prevent insertion of foreign objects such as tools, wires, or the like in any undesired attempt to reach the contacts. Completing the arc extinguishing structure is an insulating cap 52 and the aforedescribed insulator 14. Cap 52 is shown from two different angles in FIGS. 6 and 10, its basic shape being closely similar to the profile of inverted U-shaped conductor portion 8*c* of terminal/stationary contact member 8. The cap 52 is hollow, having opening 52*a* (FIG. 10) to receive the portion 8*c*. An L-shaped flange 52*b* is formed on one side to overlie the wider contact pad 8*d* and to extend under a formation in housing 2 serving as the pivot of latch lever 18. Cap 52 also serves to insulate latch lever 18 and roll pin 50, which are at load-side potential, from the line-side conductor 8*c*. Insulator 14 is disposed directly opposite cap 52 when the contacts 10 and 16 are closed and the two insulating members cooperate to impede any tendency of an arc to travel upwardly along the conducting portions 8*c* and 12*b* of the stationary and movable contacts, respectively.

The slot motor and contact and arc extinguishing structures are particularly advantageous in the interruption of short circuit currents. The stationary and movable contacts are formed to provide adjacent parallel, oppositely directed current paths which generate electromagnetic forces tending to separate the two members. Current entering the breaker through terminal 8*a* is directed downwardly in the right-hand leg of U-shaped conductor portion 8*c* to the contact mounting pad 8*d* and into stationary contact 10. That current then passes to movable contact 16, into stem 12*a* of movable contact arm 12 and upwardly within the cover-side leg 12*b* to the point at which the braided conductor 34 is attached to that leg 12*b*. As viewed in FIG. 2, the length of the parallel current paths extends from the junction of the bight of portion 8*c* with the right-hand leg to the center of the contact element 10 and from the center of contact element 16 to the point at which the braided conductor 34 is attached to leg 12*b*. By reducing the cross-sectional width of portion 8*c* and offsetting that portion to the cover side of the terminal/stationary contact member 8, the above described current path in the stationary contact member 8 is essentially aligned directly opposite the current path in the coverside leg 12*b* of the movable contact in the direction of movement of the movable contact arm 12.

The occurrence of short circuit currents flowing within the right hand leg of stationary contact member 8 and the cover-side leg of movable contact arm 12 will generate electromagnetic forces that cause the movable contact arm 12 to pivot counterclockwise about its end 12*c*, thereby separating the contacts. This action occurs much more rapidly than separation of the contacts under the tripping action of the electromagnetic trip means 20, 24 and 26. However, as the contacts separate under the electromagnetic forces of the short circuit current, the current that is let through does generate an electromagnetic tripping force which operates to attract latch 20 to pole piece 26 to release the latch lever 18 and trip the breaker mechanism open as the contact arm 12 moves toward the stop 23 under the electromagnetic forces. Accordingly, at some point in the aforementioned travel of the movable contact arm, the trip mechanism will release latch lever 18 to cause the overcenter spring 22 to drive the contact arm to rest against stop 23 and the breaker to assume the "tripped" position as shown in FIG. 3, thereby preventing reclosure of the contact 16 upon the stationary contact 10 after the short circuit current has been interrupted. The electromagnetic force continues to operate on the movable contact arm as the arm moves to the open position, thereby increasing the opening velocity of the movable contact arm. The opening velocity is enhanced by minimizing the mass of the movable contact arm 12.

Rapid extinction of the arm formed upon contact separation under high currents is necessary to reduce or hold to a minimum the let-through current carried in the arc. The fast opening velocity of the movable contact arm under short circuit conditions establishes a high rate of rise of the arc voltage which in turn reduces the let-through current. The current which is present in the arc and in the right-hand leg of the stationary contact member 8 and the arm 12*b* of the movable contact 12 establishes a magnetic force which operates to drive the arc onto the arc runner and into the arc plates 42 and 44. The forward inclination of arc runner 8*e* with respect to stationary contact 10 facilitates arc motion off the contact 10. As the arc moves downward on the arc runner, the pressure resulting from the gas generated by the arc drives the arc gasses through the opening in the arc runner and through the vent opening 2*d*. The arc gasses are similarly exhausted through right-hand vent passage 2*g* as the movable contact arm approaches stop member 23. The arc plates 42,44 are parallel to the arc runner and to each other and the space between arc runner 8*e* and arc plate 42 is substantially the same as that space between the arc plates 42 and 44. The spacing and parallelism of the arc plates and runner take advantage of the gas generated by the arc and the resulting pressure to further aid in moving the arc into the arc plates. If the plates were positioned radially along the path of the movable contact, the space between the plates at the entry end thereof, would provide a restriction to movement therethrough due to gas pressure. By mounting the plates parallel, the space between the plates is the same all along their length and no restriction to movement therethrough is created. Moreover, only two plates 42 and 44, are used in this structure to permit increased space, and thus less resistance, to fluid flow between the plates. Thus, although the number of arc plates is considerably less than conventional arc chute designs, it is preferable to use fewer plates to achieve greater space therebetween to enable more effective use of the gas generated by the arc to create arc motion.

It is recognized that various modifications are possible within the scope of the appended claims.

We claim:

1. A residential or commerical circuit breaker having a narrow case of width less than or equal to about one inch, and having a pair of separable contacts mounted on respective current carrying conductors, and comprising magnetically permeable slot motor means mounted within said case and around both said conductors, wherein:

said conductors extend parallel to each other in said slot motor means;

said case has an end wall through which an operating handle extends;

said contacts engage along a plane substantially perpendicular to said handle end wall;

said slot motor means has a U-shaped configuration and receives both said conductors therein from one side, one of said conductors being movable toward the open end of the U away from the bight of the U;

said bight of said U-shaped slot motor means extends substantially parallel to said plane of contact engagement and substantially perpendicular to said handle end wall.

2. A residential or commercial circuit breaker having a narrow case of width less than or equal to about one inch, and having a pair of separable contacts mounted on respective current carrying conductors, and comprising magnetically permeable slot motor means mounted within said case and around both said conductors, wherein:

said slot motor means has a U-shaped configuration and receives both said conductors therein from one side, one of said conductors being movable toward the open end of the U away from the bight of the U;

said case has an end wall through which an operating handle extends;

said contacts engage along a plane substantially perpendicular to said handle end wall;

said bight of said U-shaped slot motor means extends substantially parallel to said plane of contact engagement and substantially perpendicular to said handle end wall;

said contacts are within the U-shape of said slot motor means;

said operating handle is connected to one of said conductors by linkage means, and said slot motor means is disposed inwardly in a perpendicular direction from said handle end wall and is spaced inwardly beyond the innermost extent of said linkage means along said perpendicular direction.

3. A residential or commercial circuit breaker comprising in combination:

an insulating enclosing case of width less than or equal to about one inch;

separable contacts disposed within said case;

trip means for causing separation of said contacts in response to overload currents through said contacts;

arc extinguishing means positioned in said case in proximity to said separable contacts;

a lower contact arm pivoted at an upper end and having a lower free end, a first one of said separable contacts being secured to a front surface of said contact arm at said free end;

support means positioning a second one of said separable contacts in the arcuate path of travel of said first contact, said support means comprising conductive means extending from said second contact parallel to said contact arm when said contacts are engaged;

an operating mechanism for selectively causing said pivoted contact arm to move said first contact into and out of engagement with said second contact;

current flow being in opposite directions in said contact arm and said conductive means when said contacts are engaged whereby electromagnetic force generated by said current flow urges separation of said contacts; and slot motor means mounted within said case and around both said contact arm free end at said first contact and said conductive means at said second contact to concentrate the electromagnetic repulsive force urging separation of said contacts, to increase the separation force, wherein:

said case has an end wall through which an operating handle extends;

said contacts engage along a plane substantially perpendicular to said handle end wall;

said slot motor means has a U-shaped configuration and receives both said contact arm free end at said first contact and said conductive means at said second contact therein from one side, said contact arm free end at said first contact being movable toward the open end of the U away from the bight of the U upon separation of said contacts;

said bight of said U-shaped slot motor extends substantially parallel to said plane of contact engagement and substantially perpendicular to said handle end wall.

4. A residential or commercial circuit breaker comprising in combination:

an insulating enclosing case of width less than or equal to about one inch;

separable contacts disposed within said case;

trip means for causing separation of said contacts in response to overload currents through said contacts;

arc extinguishing means positioned in said case in proximity to said separable contacts;

a contact arm pivoted at an upper end and having spaced legs extending from said pivoted upper end, said legs being joined at the free end of said contact arm, a first one of said separable contacts being secured to a front surface of said contact arm at said free end;

support means positioning a second one of said separable contacts in the arcuate path of travel of said first contact, said support means comprising conductive means extending upwardly from said second contact parallel to said contact arm when said contacts are engaged;

an operating mechanism for selectively causing said pivoted contact arm to move said first contact into and out of engagement with said contact;

current flow being in opposite directions in one of said spaced legs and said conductive means when said contacts are engaged whereby electromagnetic force generated by said current flow causes said contact arm to move said first contact out of engagement with said second contact independently of said trip means and said operating mechanism;

said conductive means being offset laterally with respect to said second contact to substantially align said conductive means with said one leg of said contact arm in the direction of motion of said contact arm; and slot motor means mounted within said case and around both said contact arm free end at said first contact and said conductive means at said second contact to concentrate the electromagnetic repulsive force urging separation of said contacts, to increase the separation force.

* * * * *

UNITED STATES PATENT AND TRADEMARK OFFICE

CERTIFICATE OF CORRECTION

PATENT NO. : 4,549,153

DATED : October 22, 1985

INVENTOR(S) : KENNETH A. FORSELL ET AL

It is certified that error appears in the above-identified patent and that said Letters Patent is hereby corrected as shown below:

In Column 1, line 20, delete "sever" and insert --severe--

In Column 3, line 56, delete "inderlies" and insert --underlies--

In Column 6, line 56, delete "suitable" and insert --suitably--

In Claim 3, column 10, line 19, after "motor" insert --means--

Signed and Sealed this

*Eighteenth* Day of *March 1986*

[SEAL]

*Attest:*

DONALD J. QUIGG

*Attesting Officer*

*Commissioner of Patents and Trademarks*